US006098519A

United States Patent [19]

Takahashi et al.

[11] Patent Number: 6,098,519

[45] Date of Patent: Aug. 8, 2000

[54] FUEL PUMP

[75] Inventors: Yukio Takahashi; Hideki Machimura, both of Hitachinaka; Yoshikazu Hoshi, Tokai-mura, all of Japan

[73] Assignees: Hitachi, Ltd., Tokyo; Hitachi Car Engineering Co., Ltd., Hitachinaka, both of Japan

[21] Appl. No.: 08/925,731

[22] Filed: Sep. 9, 1997

[30] Foreign Application Priority Data

Sep. 9, 1996 [JP] Japan ..... 8-238039

[51] Int. Cl.[7] ..... F01B 3/00

[52] U.S. Cl. ..... 92/71; 74/60; 417/269

[58] Field of Search ..... 92/12.2, 71; 91/499, 91/500; 74/60; 417/269

[56] References Cited

U.S. PATENT DOCUMENTS

| | | | |
|---|---|---|---|
| 2,392,279 | 1/1946 | Woods | 92/71 |
| 4,550,630 | 11/1985 | Remus | 74/60 |
| 5,275,087 | 1/1994 | Akuzawa et al. | 417/269 |
| 5,632,607 | 5/1997 | Popescu et al. | 417/269 |
| 5,782,161 | 7/1998 | Okubo et al. | 92/71 |

FOREIGN PATENT DOCUMENTS

| | | | |
|---|---|---|---|
| 832242 | 7/1949 | Germany | 92/71 |
| 4-209981 | 7/1992 | Japan . | |

*Primary Examiner*—Thomas E. Denion
*Attorney, Agent, or Firm*—Evenson, McKeown, Edwards & Lenahan, P.L.L.C.

[57] ABSTRACT

A drive part for converting rotational movement in a fuel pump to the wobble movement includes the shaft for transmitting an outside drive force, the swash plate rotated by the shaft and the wobble plate for converting the rotational movement of the swash plate to the wobble movement. Plural pistons are reciprocated in response to the wobble movement of the wobble plate. The crank room containing the swash plate, the wobble plate and the piston are separated into the fuel room and the drive room by bellows. The bearings for transmitting the drive force between the shaft in the drive room and the swash plate, and the bearing for transmitting the drive force between the swash plate and the wobble plate are placed inside the drive room in order to lubricate the bearings. By arranging plural pistons inside the fuel room, the fuel is forced to be taken in and discharged by the reciprocating movement of the individual pistons.

1 Claim, 7 Drawing Sheets

FUEL PUMP

BACKGROUND OF THE INVENTION

This application claims the priority of Japanese application 8-238039, the disclosure of which is expressly incorporated by reference herein.

The present invention relates to a fuel pump, specifically to a fuel pump applicable for a high pressure fuel pump for the direct gas injection system for automotive gasoline engines.

In internal combustion engines, especially automotive gasoline engines, the direct gas injection system has been studied in recent years for the purpose of the improvement of fuel consumption performance, the reduction of harmful exhaust gas and the improvement of drive performance and acceleration performance.

In the direct gas injection system, in order to inject directly gasoline into the cylinders of the internal combustion engine even when the compression stroke, a high pressure fuel pump which can supply gasoline with the high pressure, for example, more than 3 MPa, is required.

In using gasoline for the lubrication of the drive part and the sealing of the rotor shaft of the fuel pump, as the viscosity of gasoline is extremely smaller than that of general purpose lubricating oil, the longevity of the rotational load support part of the drive part, especially the longevity of the bearing, becomes extremely short, and the reliability of the sealing mechanism of the rotor shaft is reduced.

In order to solve the above problem, as shown in Japanese Patent Laid Open No. 4-209981 (1992), a fuel pump is provided in which the pressure-up of the fluid can be facilitated easily by using secondary fluid having higher viscosity and lubrication properties, and the operation fluid can be pressurized up by the piston through the bellows, as well as the lubrication of the load support part such as bearing is performed by the secondary fluid, and the sealing mechanism of the rotor shaft can be established by the secondary fluid.

However, as only one piston is provided in the fuel pump described in Japanese Patent Application Laid-Open No. 4-209981 (1992), the pressure pulsation of the supplied fluid becomes larger. For the direct gas injection apparatus, it is required to establish the minimum fluctuation of the pressure of the supplied fuel with respect to the pressure control accuracy and response of the injected fuel and the flexible condition for the injection time selection. Although it is desirable to configure the piston multi-cylinder in order to reduce the pressure pulsation, the size of the fuel pump is larger in that configuration in which bellows are used for the individual piston as shown in Japanese Patent Application Laid-Open No. 4-209981 (1992).

SUMMARY OF THE INVENTION

An object of the present invention is to provide a fuel pump which has high reliability, is miniaturized, and has small pressure pulsation by lubricating the drive part using lubricating fluid.

In order to attain the above object, the fuel pump of the present invention has a shaft for transmitting a driving force provided from the outside; a swash plate rotated by the shaft; a wobble plate for converting rotational movement of the swash plate; a plurality of pistons reciprocating by wobble movement of the wobble plate; and a bulkhead for separating a fuel room and a drive room in a crank case containing the swash plate, the wobble plate and the pistons. A bearing for transmitting driving force between the shaft and the swash plate and a bearing for transmitting driving force between the swash plate and the wobble plate are placed in the drive room where those bearings are lubricated. The pistons are placed in the fuel room, with the fuel being intaken and discharged by the individual pistons.

With this configuration, a highly reliable and low pressure pulsation and small fuel pump can be obtained.

In the above described fuel pump, the bulkhead is configured with a bellows in which an interior portion of the bellows is supplied as a fuel room, and an outside portion of the bellows is supplied as a drive room. With this configuration, the leakage of the fuel can be prevented.

According to another aspect of the present invention, the fuel pump has a shaft for transmitting an outside driving force; a swash plate rotated by the shaft; a wobble plate for converting revolution movement of the swash plate; a plurality of pistons reciprocating by wobble movement of the wobble plate; and a bulkhead for separating a crank case composed of a front body and a cylinder block for containing the swash plate, the wobble plate and the pistons into two independent rooms, a part of the bulkhead being fixed at the wobble plate.

With this configuration, a highly reliable and low pressure pulsation and small-sized fuel pump can be obtained.

In the above described fuel pump, one of the two independent rooms separated by the bulkhead is supplied as a fuel room; an inlet port and an inlet valve of the piston are placed in said fuel room, whereby the fuel is directly supplied from the fuel room into a cylinder room of the piston.

In the above described fuel pump, a slipper is defined between the wobble plate and the piston, in which the contact surface of the slipper to the wobble plate is substantially a flat plane, and the contact surface of the slipper to the piston is a sphere. The slipper has a channel connected to the inlet port of the piston and the connecting port connected to the channel on the plane surface of the slipper.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE PREFERRED EMBODIMENTS

Figure 1:
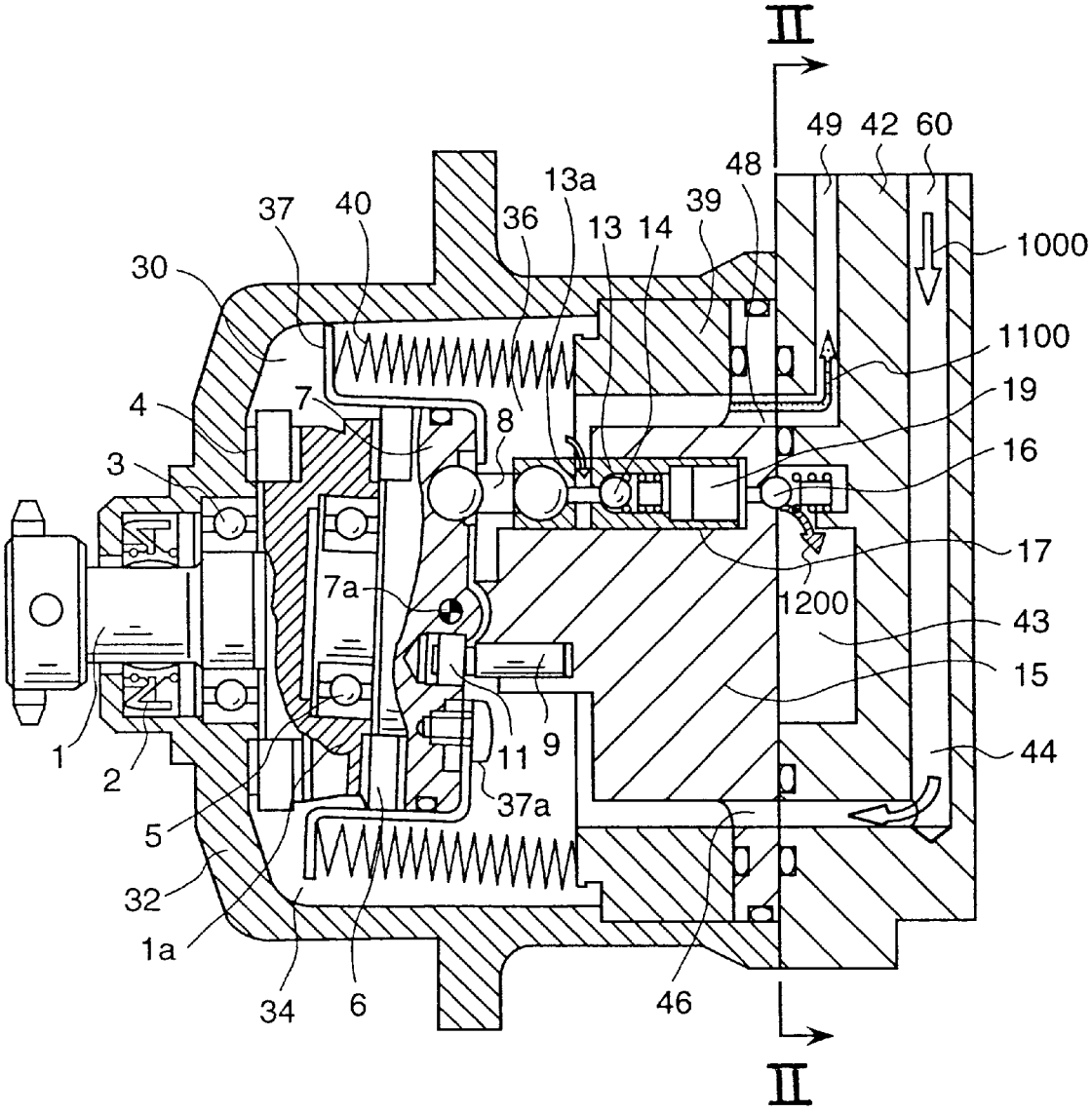
FIG. 1 is a cross sectional view of the fuel pump of a first embodiment of the present invention.
Figure 2:
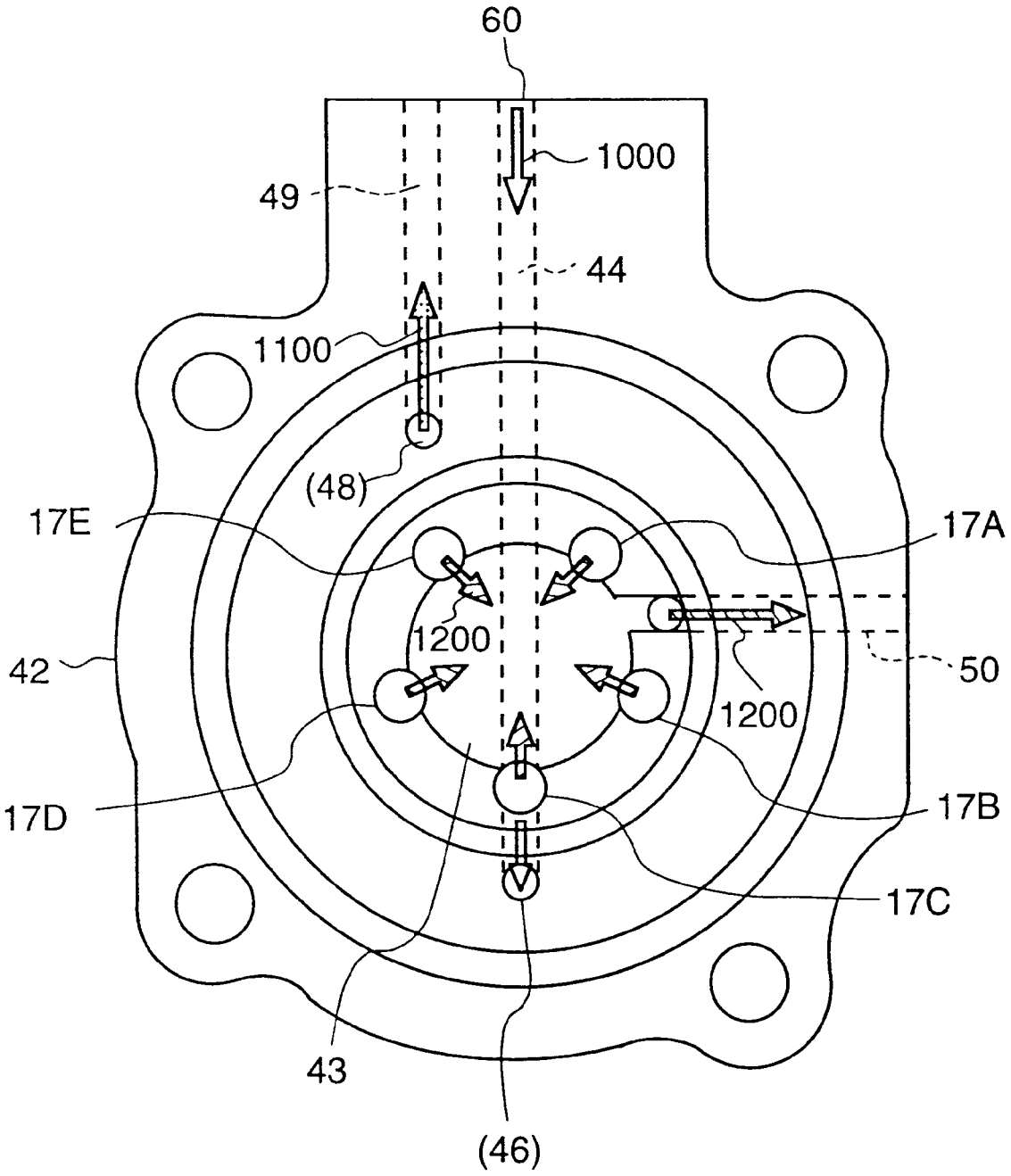
FIG. 2 is a side view of the rear body of the fuel pump of the first embodiment of the present invention, along line A—A in FIG. 1.
Figure 3:
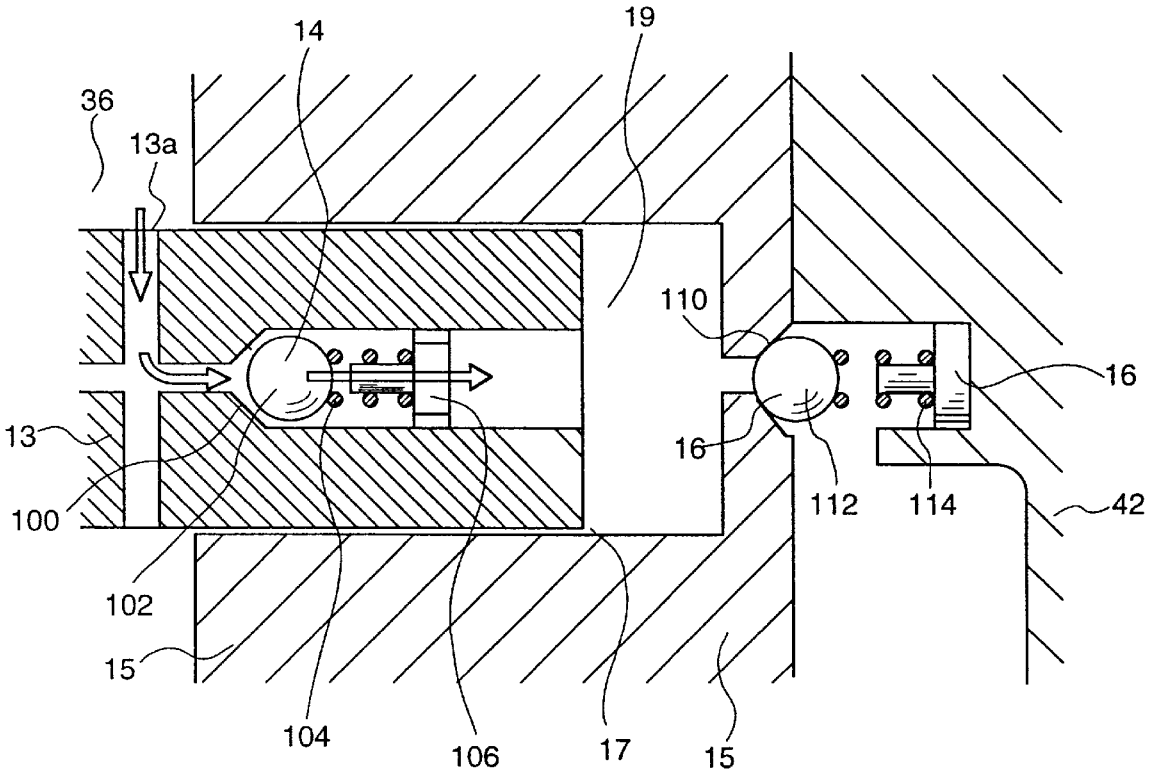
FIG. 3 is an enlarged view of the cross section of the cylinder room of the fuel pump in the first embodiment of the present invention shown in FIG. 1.

The shaft 1 of the fuel pump in FIGS. 1 to 3 is connected to the cam shaft and so on of the engine, not shown, in order to transmit the driving force. A swash plate la at the end of the shaft 1 generates the wobble motion by using the rotational movement of the shaft 1. The shaft 1 is supported by the radial bearing 3 and the thrust bearing 4 in order to establish the free rotational movement relative to the front body 32.

The wobble plate 7 is connected to the swash plate part la through the radial bearing 5 and the thrust bearing 6. The wobble plate 7 generates the wobble movement in responsive to the rotational movement of the swash plate part la of the shaft 1.

The wobble plate 7 transmits only the reciprocating movement obtained from the rotational friction and thrust friction generated by the radial bearing 5 and the thrust bearing 6 to the piston 13 through the connecting rod 8, by limiting the rotational movement with the joint pin 9 and the joint ball 11. The piston 13 is guided in the cylinder bore 17 placed in the cylinder block 15 and forms the cylinder room 19 used for pump compression by the reciprocating movement. As described later by referring to FIG. 2, there are five pistons in this embodiment, and thus, the fuel pump is so configured as to form a 5-cylinder engine.

The piston 13 has an intake valve 14. When the piston 13 moves to the intake stroke, the intake valve 14 opens and the gasoline taken in through the intake route 13*a* formed in the piston 13 is taken into the cylinder 19. The rear body 42 has a discharge valve 16. When the piston 13 moves in the right direction in FIG. 1, the discharge valve 16 opens and the gasoline remaining in the cylinder 19 is discharged out to the high pressure room 43.

The crank room 30 is formed inside the front 32 and is composed of the front body 32 and the cylinder block 15. The crank room 30 contains radial bearings 3 and 5, thrust bearings 4 and 6, the wobble plate 7, the shaft 1 and the piston 13 moving in the reciprocating manner while contacting the wobble plate 7.

The bellows caps 37 are fixed with the screws 37*a* on the outer ridge of the wobble plate 7. One end side of the bellows 40 is mounted at the bellows cap 37, and other end side of the bellows 40 is mounted at the bellows ring 39 fixed at the cylinder block 15. The bellows 40 separates the crank room 30 into two rooms, namely the drive room containing the mechanical parts for converting the rotational movement of the shaft 1 to the wobble movement, and the fuel room 36 filled with the gasoline used as the working fluid. Oil and grease used for lubricating the mechanical parts are filled in the drive room 34. The bellows 40 and the bellows cap 37, and the bellows 40 and the bellows ring 39 are fixed by TIG (Tungsten Inert Gas) Welding or Plasma Welding. Because the bellows 40 contact the gasoline directly, corrosion resistance material such as austenite-base stainless steel is used for the bellows 40. Austenite-base stainless steel includes, for example, SUS304, SUS304L, SUS316 and SUS316L.

The bellows 40 is a formed material have a U-shape. As for the fabrication method of the bellows, there are two categories, i.e. molded bellows and welded bellows. From the viewpoint of mass production, molded bellows are used in automotive applications. As the bellows is used as the seal for the wobble movement part, in order to reduce the stress concentration at the peak and bottom part of the bellows under wobble movement, the crest radius of the peak and bottom part is required to be large and hence, U-letter shaped bellows are used. Thus, by using the U-letter molded bellows, the stress generated at the bellows can be reduced as much as possible.

In this embodiment, the wobble center 7*a* of the wobble plate 7 is located inside between the both end parts of the bellows 40 in the longitudinal direction (axial direction) of the bellows. Therefore, the length of the bellows 40 can be longer than the stroke of the reciprocal movement of the piston 13, and the stress generated at the peak and/or bottom part of the bellows 40 can be reduced.

As the axial center of the individual end parts of the bellows 40, the axial center of the wobble plate 7 and the axial center of the shaft 1 are substantially identical to one another, the stresses generated at the bellows 40 are identical over all the peaks and bottoms. With this structure, the repetitive stress generated at the bellows by the wobble movement of the wobble plate 7 in responsive to every single rotation of the pump is reduced, the stress generated at the individual peak part is identical to each other, and the stress generated at the individual bottom part is identical to each other. This identical stress defined as above is under the fatigue limit for the material used for the bellows.

In order to reduce the stress generated by the vertical displacement of the bellows, the wobble center is identical to the center of the bellows in its longitudinal direction.

The oil seal 2 is installed between the shaft 1 and the front body 32, and the O-ring is installed between the bellows cap 37 and the wobble plate 7 in order to seal the drive room 34. The lubrication oil is supplied into the drive room 34 from the oil inlet port not shown but formed in the front body 32.

The rear body 42 is fixed at the front body 32 with bolts, while the bellows block 39 and the cylinder block 15 are inserted into the front body 32. The gasoline pressurized at 0.3 MPa by the feed pump mounted inside the fuel tank is taken into the rear body 42, in which the intake route 44 connected to the intake port 60, the high pressure room 43 containing the highly pressurized gasoline at 3 MPa or more by the five pistons 13, and the air vent route 49 for separating and exhausting the intake air are formed. The high pressure room 43 is connected to the discharge route to be described below by referring to FIG. 2.

Inside the cylinder block 15, the connection route 46 to be connected to the intake route 44 of the rear body 42 and the connecting route 48 connected to the air vent route 49 of the rear body 42 are formed.

The gasoline taken in from the intake port 60 is lead into the fuel room 36 via the intake route 44 and the connection route 46. The connection route 46 through which the gasoline flows is placed at the cylinder block 15 below the connection route 48 connected to the air vent route 49. Therefore, the air contained in the gasoline taken in through the connection route 46 rises up with the floating force and gathers onto the upper part of the fuel room 36, and is discharged outside through the connection route 48 and the air vent route 49.

Thus, in this embodiment, as described below by referring to FIG. 2, in order to discharge the air remaining in the fuel room outside the pump, the connection route 48 is placed at a position higher than the location of the most upper intake port to the individual cylinder in the fuel room 36. The connection route 48 is connected to the route 49 extended from the rear body 42 to the outside of the fuel pump. With this configuration, the air staying at the upper part of the fuel room 36 can be discharged outside the fuel pump.

The air vent route 49 placed at the rear body 42 can be further connected to a low pressure regulator placed at the upper part and used for regulating the pressure of the intake side in a known manner, and thus, the vent air goes back to the gasoline tank in which the gas pressure is equivalent to the atmospheric pressure. The fuel room 36 placed inside the crank room has a structure for storing the gasoline containing less air, and at the same time, the intake port 13*a* is placed at the piston 13 so that the gasoline containing less air may be taken into the individual cylinder room. Thereby, the gasoline in the fuel room 36 can be directly taken in.

Next, referring to FIG. 2, the layout configuration of the 5-cylinder piston and the layout configuration of the individual route are described.

The low pressure gasoline taken in from the intake port 60 placed at the upper part of the rear body is lead to the lowest part of the rear body 42 through the intake route 44, and is connected to the connecting route 46 of the cylinder block 15 shown in FIG. 1.

In the rear body 42, five discharge valve open ports 17A, 17B, 17C, 17D and 17E are formed. Five cylinder rooms are formed, each corresponding to the individual discharge valve open ports 17A, 17B, 17C, 17D and 17E, and thus, five pistons are so arranged.

The open port of the air vent route 49 is placed at the upper part of the rear body 42 and at the position higher than the location of the most upper intake port (corresponding to the discharge valve open ports 17A and 17E) to the individual cylinder room. The connection route 48 of the cylinder block 15 shown in FIG. 1 is connected to this open port.

The gasoline taken in from the intake port 60 is lead into the fuel room via the intake route 44 and the connection route 46. The connection route 46 through which the gasoline flows is placed below the cylinder block 15, that is, below the main body of the fuel pump, and the connection route 48 connected to the air vent route 49 is placed above the cylinder block 15, that is, above the main body of the fuel pump. Therefore, the air contained in the gasoline taken in through the connection route 46 rises up with the floating force and gathers onto the upper part of the fuel room 36, and is discharged outside through the connection route 48 and the air vent route 49.

The gasoline pressurized by five pistons is discharged out into the high pressure room 43 via the discharge valve open ports 17A, 17B, 17C, 17D and 17E, and furthermore, discharged outside from the discharge route 50.

Next, referring to FIG. 3, the structure of the cylinder room is described.

The intake valve 14 is formed inside the piston 13. The ball 102 is pressed by the spring 104 against the valve seat 100 in the piston 13, and thus, the valve seat 100 is sealed by the ball 102. In order to regulate the setting load of the spring 104, the valve stopper is fixed at the piston 13.

On the other hand, as for the structure of the discharge valve 16, the ball 112 is pressed by the spring 114 against to the valve seat 110 defined at the rear body 15 side of the cylinder, and thus, the valve seat 110 is sealed by the ball 112. In order to regulate the setting load of the spring 114, the valve stopper 116 is fixed at the rear body 15.

When the piston 13 reciprocates along the wobble plate shown in FIG. 1 and then the intake stroke begins, the volume of the cylinder room 17 increases and the pressure in the cylinder room 17 decreases. Next when a pressure difference between the front and the rear of the seat of the ball 102 occurs and the valve open force determined by the product of the cross section corresponding to the seat diameter and the pressure difference becomes larger than the set load of the spring 104, the ball 102 leaves the seat 100, and finally, the gasoline is taken into the cylinder room 19 from the intake port 13*a* of the piston 13 opening to the fuel room 36.

When the piston 13 moves into the discharge stroke, the pressure inside the cylinder room 19 increases as the volume of the cylinder room 19 decreases, and the valve close force is applied to the ball 102 in contrast to the valve open force described above, and finally, the ball 102 contacts to the seat 100 for sealing the open port. At this time, as the pressure inside the cylinder room 19 increases, the pressure difference between the front and the rear of the seat of the ball 122 of the discharge valve 16 occurs. Next, when the valve open force determined by the product of the cross section corresponding to the seat diameter and the pressure difference becomes larger than the set load of the spring 114, the ball 112 leaves the seat 112 and the discharge valve 16 opens, and finally, the gasoline is discharged out to the high pressure room 43 of the rear body 42.

With the above described structure, the pump capacity determined by the regulated stroke length can be efficiently used.

As described above, the wobble plate 7 so configured as to move not rotationally but reciprocatingly is made to be one end part of the bellows 40 used as the seal material, and the other end part of the bellows isolates the multiple-cylinder piston. Therefore, in contrast to prior art systems where the bellows are individually placed at every cylinder, the bellows used as the seal material can be reduced. Therefore, the overall structure can be simplified and the size of the fuel pump can be reduced in comparison with the prior art systems.

The crank room 30 is separated into the drive room 34 and the fuel room 36 by the bellows 40, and the drive room 34 used for converting rotational movement to reciprocating movement is filled with the lubrication oil. Therefore, the bearings 3, 4, 5 and 6 in the drive room can be operated in the high-viscosity lubrication oil, and hence, the life of the rolling bearing can be extended. Moreover, the oil seal 2 used as the seal between the rolling part of the shaft 1 and the outside can be increased, and ultimately, the leakage of the gasoline directly outside can be prevented.

The fuel room 36 is defined at the piston side, the intake gasoline is led into the lower part of the fuel room 36, and the air vent route 49 for extracting the air contained in the intake gasoline and discharging outside the pump is placed in the upper part of the fuel room 36. With this configuration, the fuel room can be also used as the air separation room. In the event that air contained in the intake gasoline and the air void generated due to a temperature rise during the pump operation remain in the compression cylinder of the bellows, a problem could arise that the expected amount of discharged gasoline determined by the regulated stroke length can not be obtained because of the development of the compressive gas, for example, the air void in the gasoline. This problem has been resolved by the above described configuration in which the contained air void can be extracted, and hence, the amount of the discharged gasoline from the fuel pump can be kept constant.

In this above-described embodiment, the gasoline is directly taken in from the fuel room 36 to the cylinder room 19 via the intake port 13*a* formed at the piston 13, and the intake valve 14 can be placed at the piston 13. Consequently, the number of O-rings can be reduced in comparison with the structure in which the intake valve and the discharge valve are sealed independently.

The crank room 30 is separated into two independent rooms, i.e. the fuel room 36 and the drive room 34, by the bellows 40. The fuel room 36 is placed inside the bellows 40, and the drive room 34 is placed outside the bellows 40.

With this configuration, as the drive room 34 is located outside the fuel room 36, the drive room 34 is used as a gasoline leakage protection room which leads to an effective way of protecting the leakage of the gasoline outside to the atmosphere.

As it is required to make the front body 32 have such a structure member as a mounting device for fixing the pump on the engine, the shape of the front body may be complex. Because the front body 32 is provided with the lubrication oil sealing function in the present invention, the casting parts which have previously been fabricated with relative ease but have never been used because of low reliability in porosity handling with low viscosity fluid can now be used with higher reliability. Therefore, the productivity of the fuel pump can be increased.

According to the above-described embodiment, the reliability of the fuel pump can be increased substantially by lubricating the drive part with the lubricating fluid, and the pressure pulsation can be substantially reduced by using multiple-cylinder pistons. In addition, the size of the fuel pump can be reduced with the configuration in which all the multiple-cylinder pistons are isolated.

By using the U-shaped molded bellows, the stress generated in the bellows can be greatly reduced.

The stress generated in the top and bottom part of the bellows can also be reduced.

As the drive room for converting the revolution movement to the reciprocating movement is filled with the lubricating oil, the reliability of the drive room can be increased.

By using a structure enabling the air contained in the gasoline to be extracted, the amount of discharged gasoline from the fuel pump can be kept constant.

By providing the piston with an intake valve, the number of O-rings can be reduced.

Because the fuel room is located inside the bellows and the drive room is located outside the bellows, the leakage of the gasoline outside atmosphere can be effectively protected. Therefore, casting parts can be used as the material for the front body, and ultimately, the productivity of the fuel pump can be increased.

Figure 4:
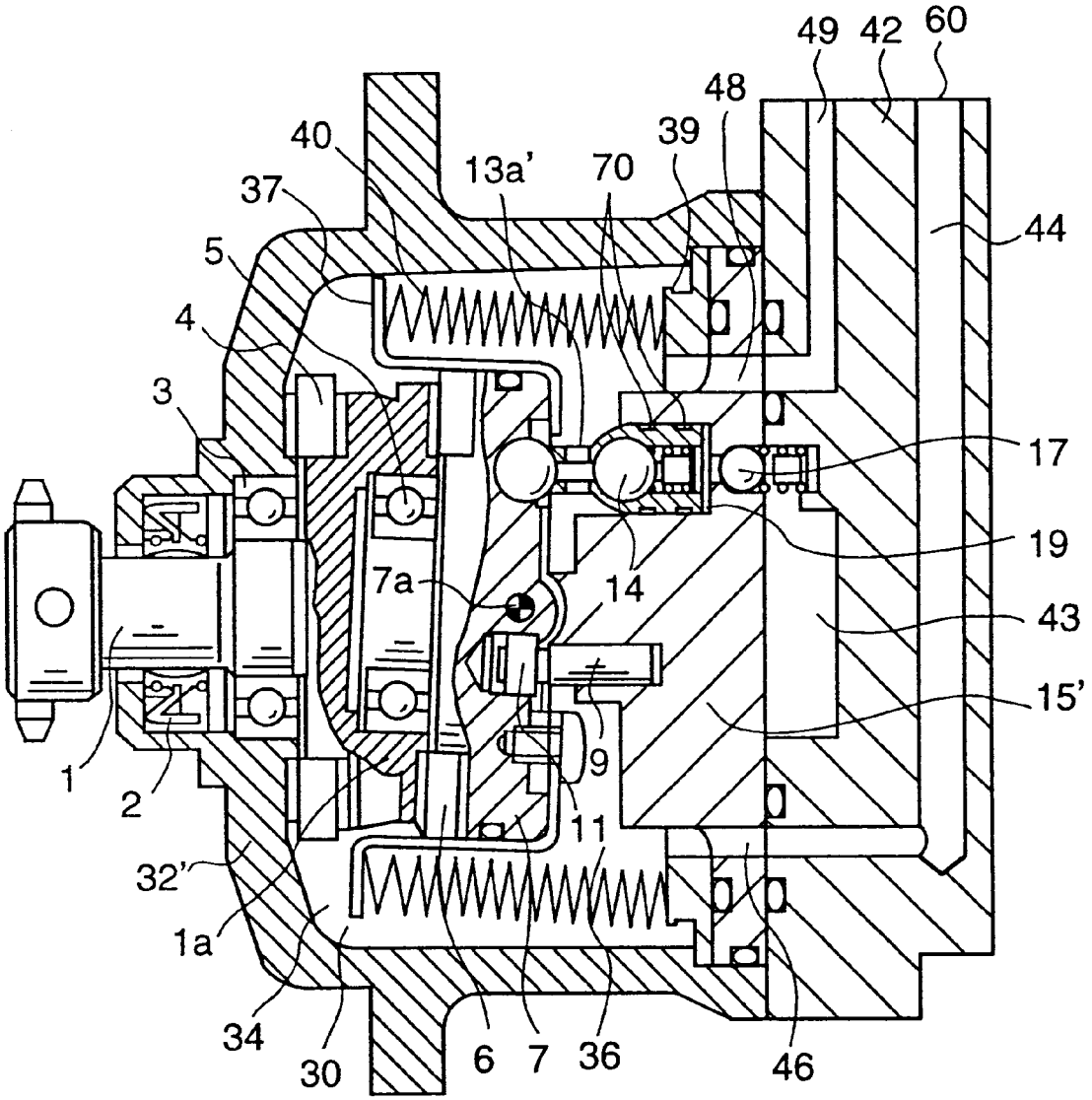
FIG. 4 is a cross sectional view of the fuel pump of a second embodiment of the present invention.

Next, by referring to FIG. 4, a second embodiment of the fuel pump in accordance with the present invention is described.

The specific point of this embodiment is that the piston 13*a*' has a piston ring 70 made of a material whose major component is PTFE resin (Poly-Tetra-Floro-ethylene). Resin material is effective for the material used for the piston ring because the resin-base material can fit the shape of the cylinder bore in order to keep the sealing effect of the piston ring even when the fabrication accuracy of the cylinder bore is not high and that the working fluid is low viscosity gasoline. The resin-base material with its major component being PTFE is an especially good choice when considering stability and friction properties. By mounting the piston ring made of PTFE on the piston 13*a*', a self-seal effect obtained by the internal pressure generated in the cylinder room 19 is achieved.

In the piston without a piston ring as shown in FIG. 1, a seal effect established only by the gap defined between the piston and the cylinder block is inevitable, and hence, high precision fabrication with several mm gap between the piston and the cylinder block is required. On the other hand, in the embodiment shown in FIG. 4 in which the piston 13*a* has a piston ring 70 and the piston ring provides a seal effect, as the allowable gap between the piston and the cylinder block bore can be taken to be as large as several ten mm, so high precision fabrication is not required, and ultimately, the productivity can be increased.

As shown in FIG. 1, in the event that a seal effect is established only by the gap between the piston without a piston ring and the cylinder block bore, the length of the effective seal part (the length of the friction region defined in the direction of the wobble movement of the piston and the cylinder block) is required to be 10 to 20 mm. With a piston having a piston ring, however, the length of the effective seal part is equivalent to the thickness of the piston ring, for example, 2 to 3 mm, which can give enough seal effect. Consequently, the length of the cylinder block 15', the bellows block 39' and the front body 32' measured in their axial direction can be reduced by 15 to 16 mm. Therefore, the fuel pump of FIG. 4 applied to the gas direct injection apparatus for the automotive engine provides for the transmission of the drive force of the cam shaft in the engine room to the shaft 1 of the fuel pump. Thus, if the space for mounting the fuel pump in the engine room is limited, the short-length fuel pump is more effective.

According to the FIG. 4 embodiment described above, the reliability can be substantially increased by lubricating the drive part with the lubricating fluid, and the pressure pulsation can be substantially reduced by using multiple-cylinder pistons. In addition, the size of the fuel pump can be reduced with the configuration in which all the multiple-cylinder pistons are isolated in the manner of the present invention.

By using the U-letter molded bellows, the stress generated in the bellows can be reduced as much as possible.

The stress generated in the top and bottom part of the bellows can be reduced.

Because the drive room for converting the revolution movement to the reciprocating movement is filled with the lubricating oil, the reliability of the drive room can be increased.

By using the structure enabling to extract the air contained in the gasoline, the amount of discharged gasoline from the fuel pump can be kept constant.

By making the piston have an intake valve, the number of O-rings can be reduced.

Because the fuel room is located inside the bellows and the drive room is located outside the bellows, the leakage of the gasoline outside to the atmosphere can be effectively protected. Therefore, casting parts can be used as the front body material, and ultimately, mass productibility of the fuel pump is increased.

According to this embodiment, by using the piston ring, high-precision fabrication is not required, and a higher productivity can be achieved.

In addition, by using the piston ring, the length of the fuel pump measured in the axial direction can reduced, as well as the size of the fuel pump.

Figure 5:
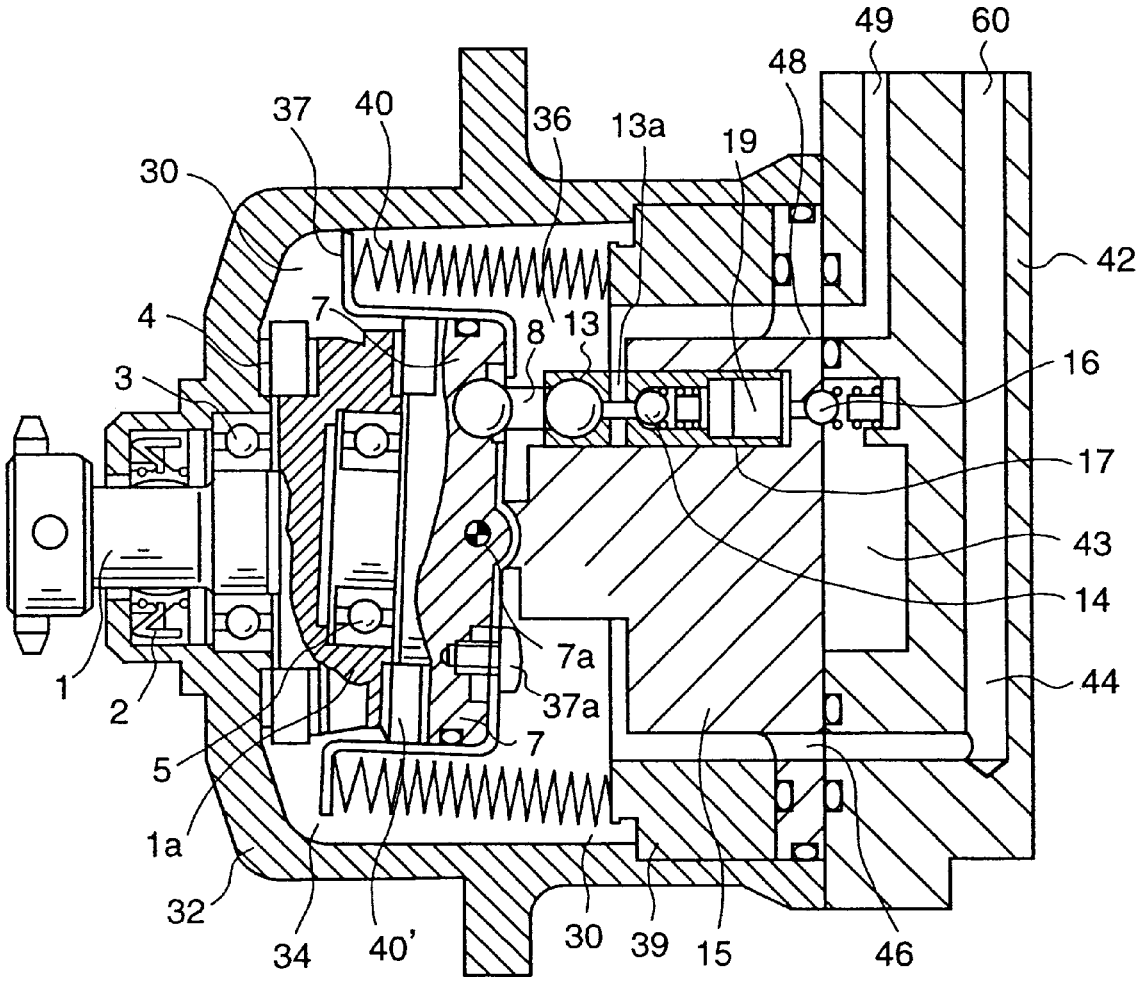
FIG. 5 is a cross sectional view of the fuel pump of a third embodiment of the present invention.

Next, by referring to FIG. 5, a third embodiment of the fuel pump in accordance with the present invention is described.

As with FIG. 4, the parts in FIG. 5 identical in function to those in FIG. 1 have identical numerals.

The specific aspect of this embodiment is that the joint pin 9 and the joint ball 11 shown in FIG. 1 have been eliminated. In the embodiment shown in FIG. 1, the rotational and wobble friction is used by the joint pin 9 and the joint ball 11 for preventing rotational movement of the wobble plate 7.

In contrast, in the embodiment of FIG. 5, the prevention of the rotational movement of the wobble plate 7 is achieved with the torsional rigidity of the bellows 40' without using the joint pin 9 and the joint ball 11. In order to assure this rotational-preventive motion, the rigidity of the bellows 40' shown in FIG. 5 is a little larger than that of the bellows 40 shown in FIG. 1.

With this structure in which the joint pin and the joint ball is unnecessary, the number of parts can be reduced and the fabrication of the fuel pump is easier.

According to the embodiment of FIG. 5, the reliability is substantially increased by lubricating the drive part with the lubricating fluid, and the pressure pulsation can be substantially reduced by using multiple-cylinder pistons. In addition, the size of the fuel pump can be reduced with isolation of all the multiple-cylinder pistons in accordance with the teachings of the present invention.

By using the U-shaped molded bellows, the stress generated in the bellows can be substantially reduced.

The stress generated in the top and bottom part of the bellows can be reduced.

Because the drive room for converting the revolution movement to the reciprocating movement is filled with the lubricating oil, the reliability of the drive room can be increased.

By using the structure which enables extraction of the air contained in the gasoline, the amount of discharged gasoline from the fuel pump can be kept constant.

By providing the piston with an intake valve, the number of O-rings can be reduced.

Because the fuel room is located inside the bellows and the drive room is located outside the bellows, the leakage of the gasoline outside to the atmosphere can be effectively protected. Therefore, casting parts can be used as the front body material, and ultimately, the mass producibility of the fuel pump can be increased.

In addition, according to the embodiment of FIG. 5, the joint pin and the joint ball are not necessary, and hence, the number of parts can be reduced to make fabrication of the fuel pump easier.

Figure 6:
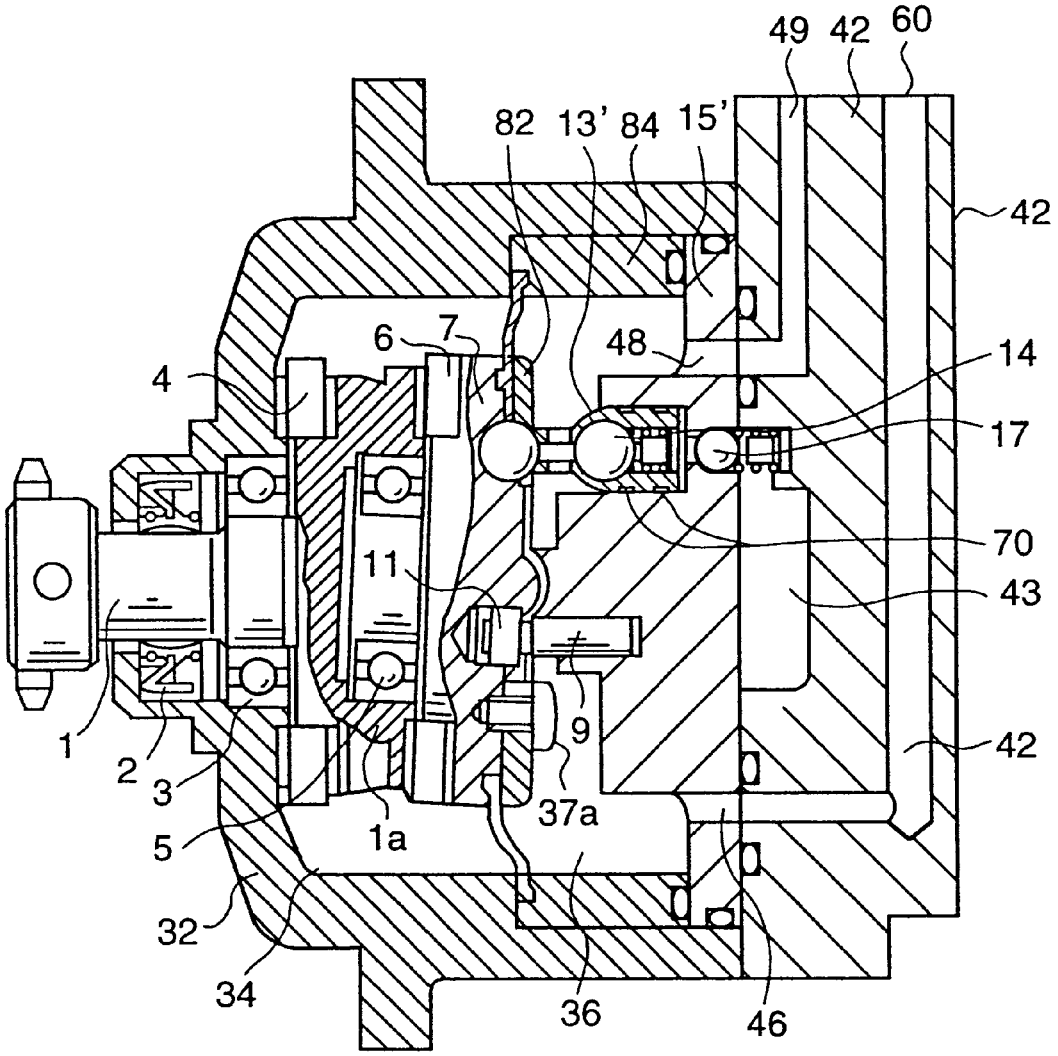
FIG. 6 is a cross sectional of the fuel pump of a fourth embodiment of the present invention.

Next, by referring to FIG. 6, a fourth embodiment of the fuel pump in accordance with the present invention is described.

The parts in FIG. 6 functionally identical to those in FIG. 4 use identical numerals.

The specific aspect of the embodiment of FIG. 6 is that the diaphragm 80 is used as the bulkhead for separating the crank room 30 into the drive room 34 and the fuel room 36. The internal edge of the diaphragm 80 is inserted between the wobble plate 7 and the rod press 82, and is bound and fixed by the screw 37*a*. The outer edge of the diaphragm 80 is inserted between the inside of the front body 32' and the diaphragm block 84, and is fixed by bolting together the front body 32' and the rear body 42.

The optimal material used for the diaphragm 80 should trace the wobble movement and generate less stress. Hence, rubber material or PTFE-base material is a good choice and reduces size of the fuel pump. Though a metallic diaphragm is more durable under repetitive wobble movement, the size of the metallic diaphragm is relatively larger.

Though the both ends of the bellows are required to be welded in the structure in which the bellows shown in FIG. 1 is used, the welding work can be eliminated in the FIG. 6 embodiment.

The length of the bellows in its longitudinal direction can be shortened, and easier fabrication of the fuel pump can be achieved.

According to the embodiment of FIG. 6, the reliability can be substantially increased by lubricating the drive part with the lubricating fluid, and the pressure pulsation can be substantially reduced by using multiple-cylinder pistons. In addition, the size of the fuel pump can be reduced by isolating all the multiple-cylinder pistons according to the present invention.

Because the drive room for converting the rotational movement to reciprocating movement is filled with the lubricating oil, the reliability of the drive room can be increased.

By using the structure which enables extraction of the air contained in the gasoline, the amount of discharged gasoline from the fuel pump can be kept constant.

By making the piston have an intake valve, the number of O-rings can be reduced.

Because the fuel room is located inside the bellows and the drive room is located outside the bellows, the leakage of the gasoline outside to the atmosphere can be effectively protected. Therefore, casting parts can be used as the front body material, and ultimately, the productivity of the fuel pump can be increased.

In addition, by using the piston ring, high-precision fabrication is not required, and productivity can be increased.

In addition, by using a piston ring, the length of the fuel pump measured in the axial direction can be decreased, and the overall size of the fuel pump can be reduced.

In addition, in the embodiment of FIG. 6, by using the diaphragm, the welding work can be eliminated.

The length of the bellows in its longitudinal direction can be shortened, and the fabrication of the fuel pump can be made much easier.

Figure 7:
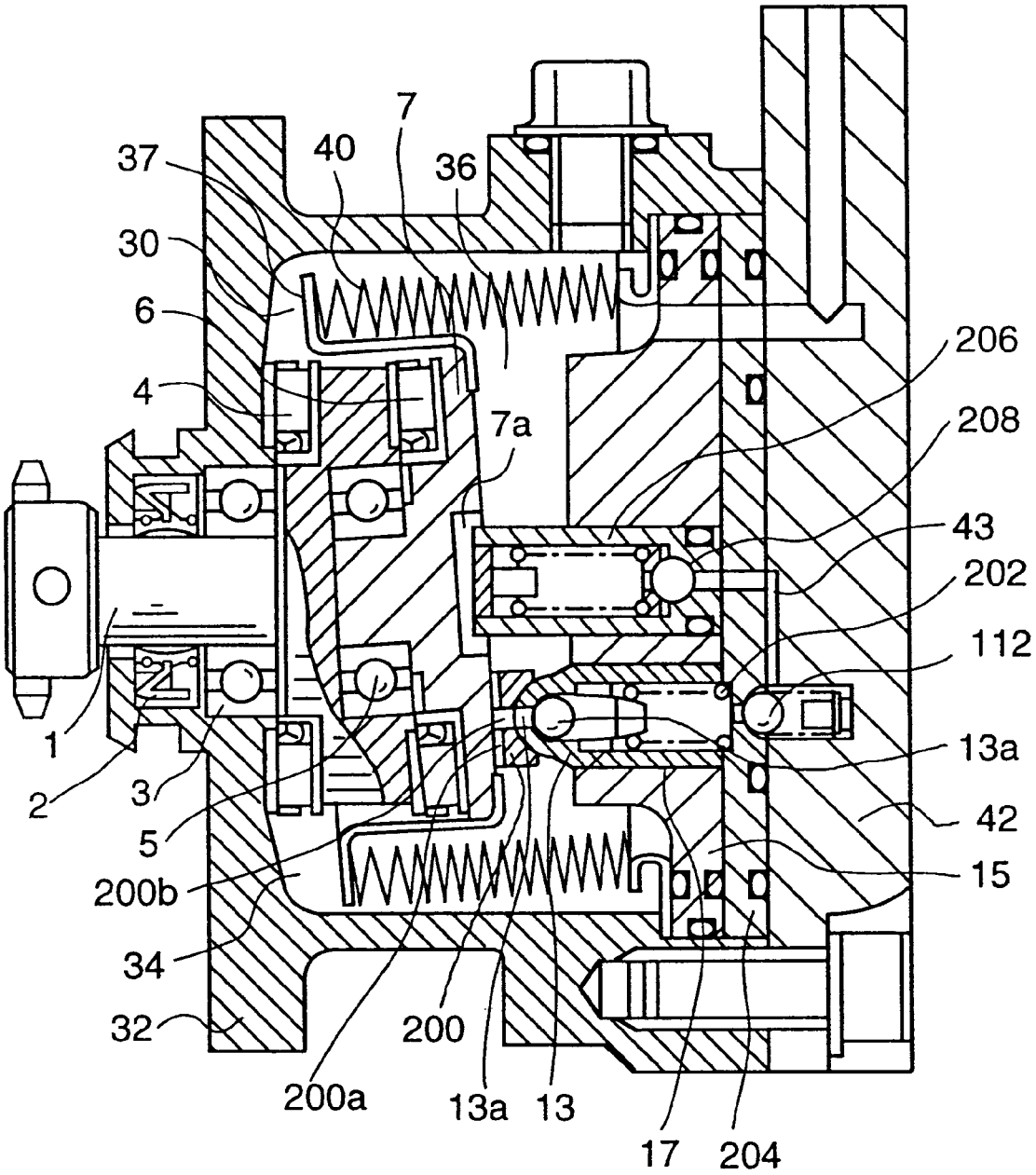
FIG. 7 is a cross sectional view of the fuel pump of a fifth embodiment of the present invention.

Next, by referring to FIG. 7, a fifth embodiment of the fuel pump in accordance with the present invention is described.

Again, parts in FIG. 7 identical structurally and/or fundamentally to those in FIG. 1 use identical numerals.

In the embodiment shown in FIG. 1, the piston 13 and the wobble plate 7 are connected to each other by the connecting rod 8. In contrast, the specific aspect of the FIG. 7 embodiment is that a slipper 200 is formed between the piston 13 and the wobble plate 7. The piston ring 202 is placed in order to allow the piston 13 and the slipper 200 to contact the wobble plate 7.

The cylinder bore of the cylinder block 15 forms a penetration hole, and the valve seat 204 forming the seat part of the ball 112 of the discharge valve is placed between the cylinder block 15 and the rear body 42. In this embodiment where the cylinder bore 17 is formed as a penetration hole and the penetration hole is partially plugged by the valve seat 204, the piston 13 can be easily inserted into the cylinder bore 17. Therefore, the fabrication of the fuel pump is easier.

The intake channel 200*a* for leading the fuel into the piston 13 is formed at the wobble plate side of the slipper 200. The connection port 200*b* connecting to the intake channel 200*a* is formed at the center of the slipper 200. As the slipper 200 can itself rotate freely, the intake channel 200*a* can rotate, and hence, the fuel is continuously supplied to the contact part between the bottom face of the slipper 200 and the wobble plate 7. Therefore, as the contact part between the bottom face of the slipper 200 and the wobble plate 7 works as the intake route, the intake channel 200*a* operates effectively with respect to wobble movement.

The intake connection route 13*a* connecting continuously to the slipper connection port 200*b* is placed on the center axis of the piston 13, and the fuel is led to the intake valve 13*a* placed inside the piston 13.

The surface of the slipper 200 contacting the piston 13 is concave, and the surface of the piston 13 contacting the slipper 200 is convex. Of course, the surface of the slipper 200 contacting to the piston 13 can be convex, and the surface of the piston 13 contacting to the slipper 200 can be concave. In the latter arrangement, the piston 13 can be inserted into the slipper 200 more easily.

The highly-pressurized fuel flowing out from the ball 112 of the discharge valve flows into the high pressure room 43. Though the discharge route for leading the fuel contained in the high pressure room 43 to the outside is not shown in FIG. 7, the discharge route is formed inside the rear block 42 as shown in FIG. 2.

Though the intake route for leading the fuel into the fuel room 36 is not shown in FIG. 7, the intake route is formed inside the rear block 42 as shown in FIG. 2.

The relief valve 206 is placed at the center of the cylinder block 15. In the event that the fuel pressure inside the high pressure room 43 becomes extremely high, the ball 208 is pushed by the highly-pressurized fuel, and the fuel is released into the fuel room 36 under lower pressure.

The wobble center 7*a* is defined to be located at the center of the extension of the bellows 40 in its longitudinal direction and on the axial center.

According to the FIG. 7 embodiment described above, the reliability is increased by lubricating the drive part with the lubricating fluid, and the pressure pulsation can be substantially reduced by using multi-cylinder pistons. In addition, the size of the fuel pump can be reduced by isolating all the multiple-cylinder pistons in the manner of the present invention.

By forming the cylinder bore as a penetration hole and partially plugging the penetration hole by the valve seat, the piston can be easily inserted into the cylinder bore, and hence, the fabrication of the fuel pump is easier.

By using the U-shaped molded bellows, the stress generated in the bellows can be greatly reduced.

The stress generated in the top and bottom part of the bellows can be reduced.

Because the drive room for converting rotational movement to reciprocating movement is filled with the lubricating oil, the reliability of the drive room can be increased.

By using the structure which enables extraction of the air contained in the gasoline, the amount of discharged gasoline from the fuel pump can be kept constant.

Because the fuel room is located inside the bellows and the drive room is located outside the bellows, the leakage of the gasoline outside to the atmosphere can be effectively protected. Therefore, casting parts can be used as the front body material, and ultimately, the mass producibility of the fuel pump can be increased.

Major embodiments of the present invention include the following advantages:

By making the wobble center defined as the crossing point of the center axis of the wobble plate and the center axis of the shaft positioned in the midpoint between the both end sides of the bellows, the stress generated in the bellows can be reduced as much as possible.

By positioning at least one of the center axis of the both ends of the bellows so as to be exactly identical to the central axis of the wobble plate, the stress generated in the bellows can be reduced as much as possible.

By forming the bellows so as to be molded in a U-letter shape, the stress generated in the bellows can be reduced as much as possible.

The material used for the bellows is austenite-base stainless steel material.

The bulkhead is formed by a diaphragm.

By placing the gas discharge route from the fuel room to the outside of the pump at the position higher than the intake port located in the highest position among the intake ports connected to the individual cylinders of the plural pistons the air remaining in the upper part of the fuel room can be discharged outside the fuel pump.

By arranging the intake port formed in the piston and the intake valve formed in the piston so as to take in the gasoline from the fuel room directly to the cylinder room of the piston, the number of O-rings can be reduced.

By making the piston having a piston ring, the seal length of the piston can be made shorter and the size of the fuel pump can be made smaller.

According to the present invention, it will be appreciated that the reliability of the fuel pump can be increased, and that the pressure pulsation can be reduced as well as the size of the fuel pump can be further reduced.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A fuel pump comprising a shaft for transmitting a driving force;

a swash plate rotated by said shaft;

a wobble plate for converting rotational movement of said swash plate;

a plurality of pistons arranged to reciprocate by wobble movement of said wobble plate; and a bulkhead for separating a crank case composed of a front body and a cylinder block for storing said swash plate, said wobble plate and said pistons into two independent rooms, wherein a part of said bulkhead is fixed at said wobble plate;

a slipper defined between said wobble plate and said pistons;

wherein a surface of said slipper contacting said wobble plate is substantially planar, and a surface of said slipper contacting said piston is spherical; and said slipper has a channel connected to an inlet port of said piston and a connecting port connected to said channel on the planar surface of said slipper.

* * * * *